US007874190B2

(12) United States Patent
Krisch et al.

(10) Patent No.: US 7,874,190 B2
(45) Date of Patent: Jan. 25, 2011

(54) ELECTROMECHANICAL LOCK CYLINDER

(75) Inventors: Volker Krisch, Hamburg (DE); Hardy Bismark, Norderstedt (DE); Bernhard Mueller, Hannover (DE); Jürgen Hofmann, Erfurt (DE); Bertrand Roland, Hamburg (DE)

(73) Assignee: ASSA Abloy AB, Stockholm (SE)

( * ) Notice: Subject to any disclaimer, the term of this patent is extended or adjusted under 35 U.S.C. 154(b) by 396 days.

(21) Appl. No.: 10/562,166

(22) PCT Filed: Jun. 22, 2004

(86) PCT No.: PCT/EP2004/006708

§ 371 (c)(1),
(2), (4) Date: Jun. 5, 2006

(87) PCT Pub. No.: WO2005/001224

PCT Pub. Date: Jan. 6, 2005

(65) Prior Publication Data

US 2006/0213240 A1 Sep. 28, 2006

(30) Foreign Application Priority Data

Jun. 23, 2003 (DE) ..... 103 28 297

(51) Int. Cl.
*E05B 47/00* (2006.01)
*E05B 47/06* (2006.01)

(52) U.S. Cl. ..... 70/277; 70/283; 70/278.7

(58) Field of Classification Search ..... 70/278.1, 70/278.7, 275, 277, 278.2, 283, 221–224
See application file for complete search history.

(56) References Cited

U.S. PATENT DOCUMENTS 3,009,349 A 11/1961 Check (Continued)

FOREIGN PATENT DOCUMENTS

DE 19525196 1/1997

(Continued)

OTHER PUBLICATIONS

Computer Generated Translation of EP1 065 335 A1, European Patent Office Website, http://gb.espacenet.com/search97cgi/s97_cgi.exe?Action=FormGen&Template=gb/EN/home.hts.*

(Continued)

*Primary Examiner*—Suzanne D Barrett
*Assistant Examiner*—Alyson M Merlino
(74) *Attorney, Agent, or Firm*—Sheridan Ross P.C.

(57) ABSTRACT

The invention concerns an electromechanical lock cylinder that cooperates with evaluation electronics to recognize access authorization and has a housing that includes two opposite cylindrical receptacles, in which a lock core, which can be operated by a key, or a knob shaft, which is connected to rotate in unison with a know, are mounted to rotation, in which the lock core and/or knob shaft cooperate with a lock tab, which operates, in particular, a bolt or latch with a door lock, and, with a fitting key or access authorization, an electromechanically driven blocking or coupling element is moved from the rest position to an operating position and produces a splined connection between the key or knob and the lock tab, characterized by the fact that the lock tab is freely rotatable relative to the two lock cores or the two knob shafts in the rest position of the blocking or coupling element.

50 Claims, 5 Drawing Sheets

U.S. PATENT DOCUMENTS

Figure 1:
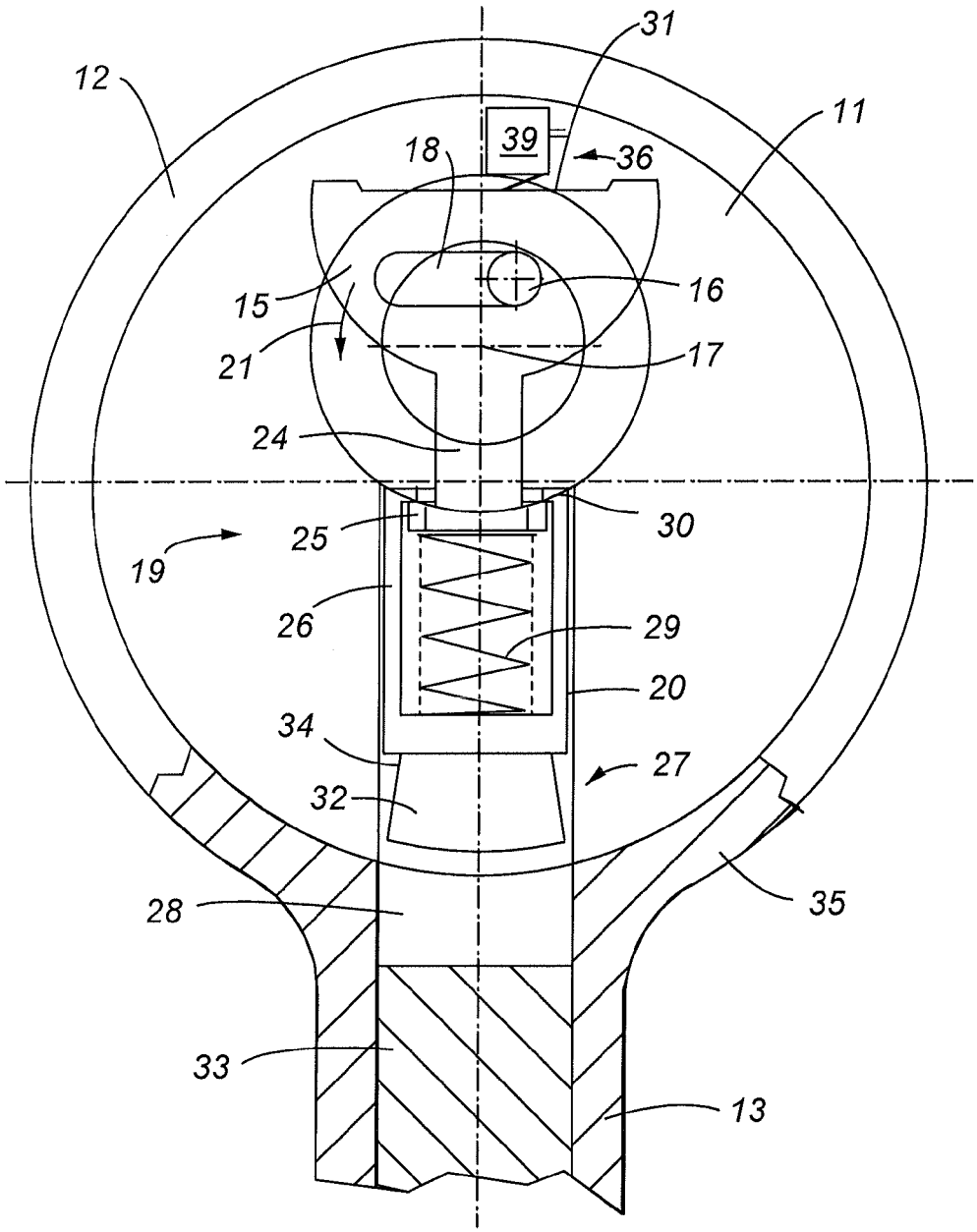

| | | | | |
|---|---|---|---|---|
| 3,713,311 | A | 1/1973 | Oliver et al. | |
| 4,073,527 | A * | 2/1978 | Schlage | 292/347 |
| 4,123,926 | A | 11/1978 | Elder | |
| 4,386,510 | A | 6/1983 | Best et al. | |
| 4,810,014 | A * | 3/1989 | McGourty et al. | 292/144 |
| 4,832,385 | A | 5/1989 | Llort | |
| 4,856,310 | A | 8/1989 | Parienti | |
| 4,901,545 | A | 2/1990 | Bacon et al. | |
| 4,939,915 | A * | 7/1990 | Vonlanthen | 70/277 |
| 4,953,373 | A | 9/1990 | Toledano | |
| 5,010,750 | A * | 4/1991 | Boser et al. | 70/276 |
| 5,027,629 | A | 7/1991 | Liu | |
| 5,542,274 | A | 8/1996 | Thordmark et al. | |
| 5,628,217 | A * | 5/1997 | Herrera | 70/278.3 |
| 5,791,177 | A | 8/1998 | Bianco | |
| 5,826,450 | A * | 10/1998 | Lerchner et al. | 70/278.3 |
| 5,839,305 | A * | 11/1998 | Aston | 70/283.1 |
| 5,848,541 | A | 12/1998 | Glick et al. | |
| 5,946,956 | A | 9/1999 | Hotzl | |
| 6,079,238 | A | 6/2000 | Hoffmann et al. | |
| 6,079,240 | A | 6/2000 | Shvarts | |
| 6,101,856 | A | 8/2000 | Pelletier et al. | |
| 6,158,259 | A * | 12/2000 | Schmitz et al. | 70/276 |
| 6,264,256 | B1 | 7/2001 | Hankel et al. | |
| 6,286,347 | B1 | 9/2001 | Frolov | |
| 6,301,942 | B1 | 10/2001 | Shvarts | |
| 6,334,347 | B1 * | 1/2002 | Iscla | 70/278.3 |
| 6,374,653 | B1 | 4/2002 | Gokcebay et al. | |
| 6,384,711 | B1 | 5/2002 | Cregger et al. | |
| 6,474,122 | B2 | 11/2002 | Davis | |
| 6,487,884 | B1 | 12/2002 | Constantinou | |
| 6,523,377 | B1 * | 2/2003 | Vonlanthen | 70/278.3 |
| 6,526,791 | B2 | 3/2003 | Shvarts | |
| 6,564,600 | B1 | 5/2003 | Davis | |
| 6,564,601 | B2 | 5/2003 | Hyatt Jr. | |
| 6,578,396 | B2 | 6/2003 | Field et al. | |
| 6,604,394 | B2 | 8/2003 | Davis | |
| 6,615,625 | B2 | 9/2003 | Davis | |
| 6,640,594 | B1 | 11/2003 | Yao | |
| 6,651,468 | B2 | 11/2003 | Aramburu et al. | |
| 6,718,806 | B2 | 4/2004 | Davis | |
| 6,725,693 | B2 | 4/2004 | Yu et al. | |
| 6,826,935 | B2 | 12/2004 | Gokcebay et al. | |
| 6,840,072 | B2 | 1/2005 | Russell et al. | |
| 6,865,916 | B2 * | 3/2005 | Goldman | 70/472 |
| 6,895,792 | B2 | 5/2005 | Davis | |
| 7,193,503 | B2 | 3/2007 | Fisher | |
| 7,275,402 | B2 | 10/2007 | Luling et al. | |
| 2002/0189307 | A1 * | 12/2002 | Gokcebay et al. | 70/278.3 |
| 2003/0200778 | A1 | 10/2003 | Chhatwal | |
| 2004/0159135 | A1 | 8/2004 | Kato et al. | |
| 2005/0265796 | A1 | 12/2005 | Persson | |

FOREIGN PATENT DOCUMENTS

| | | |
|---|---|---|
| DE | 29703559 | 4/1997 |
| DE | 196 03 320 | 8/1997 |
| DE | 19851308 | 5/1999 |
| DE | 19822865 | 11/1999 |
| DE | 199 19 283 | 12/1999 |
| DE | 19854879 | 8/2000 |
| DE | 19930054 | 1/2001 |
| DE | 10100787 | 7/2002 |
| DE | 101 63 355 | 3/2003 |
| DE | 10225368 | 7/2003 |
| DE | 10328297 | 1/2005 |
| EP | 0 243 586 | 11/1987 |
| EP | 0453878 | 10/1991 |
| EP | 0899399 | 3/1999 |
| EP | 0924369 | 6/1999 |
| EP | 1022415 | 7/2000 |
| EP | 1065335 | 1/2001 |
| EP | 1079051 | 2/2001 |
| EP | 1174572 | 1/2002 |
| EP | 1256671 | 11/2002 |
| EP | 1378620 | 1/2004 |
| EP | 1679414 | 7/2006 |
| WO | WO-02088492 | 7/2002 |
| WO | WO 03/097970 | 11/2003 |
| WO | WO 2005/001224 | 1/2005 |

OTHER PUBLICATIONS

Computer Generated Translation of WO 02/088492 A2, European Patent Office Website, http://gb.espacenet.com/search97cgi/s97_cgi.exe?Action=FormGen&Template=gb/EN/home.hts.*
International Search Report for PCT/EP2004/006708.
U.S. Appl. No. 11/424,436, Lange (Jun. 15, 2006).
U.S. Appl. No. 11/424,437, Lange (Jun. 15, 2006).
U.S. Appl. No. 11/534,509, Padilla (Sep. 22, 2006).
U.S.Appl. No. 11/534518, Padilla (Sep. 22, 2006).
Written Opinion for International (PCT) Patent Application No. PCT/EP2004/006708.
International Preliminary Report on Patentability (including translation) for International (PCT) Patent Application No. PCT/EP2004/006708, dated Jun. 20, 2005.
Official Action for U.S. Appl. No. 11/534,518, mailed May 16, 2007.
Official Action for U.S. Appl. No. 11/534,518, mailed Oct. 10, 2007.
Official Action for U.S. Appl. No. 11/534,518, mailed Feb. 11, 2008.
Official Action for U.S. Appl. No. 11/534,209, mailed Apr. 18, 2007.
Official Action for U.S. Appl. No. 11/534,209, mailed Nov. 1, 2007.

* cited by examiner

ELECTROMECHANICAL LOCK CYLINDER

The invention concerns an electromechanical lock cylinder, which cooperates with an evaluation electronics to recognize access authorization, and has a housing, provided with at least one receptacle, in which at least one lock core, which can be operated by a key, or a knob shaft, is mounted to rotate, which is connected to rotate in unison with a knob for activation, in which the lock core or knob shaft cooperates with a lock tab that operates, in particular, a bolt or a latch of a door lock, and when the key fits and/or access authorization is recognized, an electromechanically driven blocking or coupling element is moved from the rest position to an operating position, in which a splined connection exists between the key and/or knob and the lock tab.

The invention pertains to a lock cylinder on both sides with two opposite receptacles, in which either a lock core is mounted on both sides or a knob shaft on both sides, or in which a knob shaft is mounted on one side and a lock core on the other side. The invention also pertains to a one-sided lock cylinder, a so-called half-cylinder, with only one receptacle, in which either the lock core or a knob shaft is mounted to rotate.

In electromechanical lock cylinders, which can be operated with a key, in addition to the still frequently required mechanically fitting key, a corresponding electronically readable code is also required, in order to produce an effective connection between the key and lock tab. The electronically readable code can be supplied in wireless fashion via a transponder or via electrical contacts to evaluation electronics. The evaluation electronics controls the electromagnetic blocking or coupling element, so that the lock tab can be rotated. Such lock cylinders are known in different variants.

Such a lock cylinder is disclosed, for example, by DE 199 30 054 A1. Here, the arrangement is such that on one side of the cylinder housing, a rotating knob is present, which is connected to rotate in unison to the lock tab via the knob shaft. Operation is therefore always possible from this side. On the opposite side, the lock cylinder can be operated by a key, which additionally carries electrical coding. The evaluation electronics are situated in a rotating knob and the decoding signal must be fed from an antenna arranged in the cylinder housing to the evaluation electronics via at least one slip ring contact. Such slip ring contacts are relatively costly to produce in the required reliability.

There is a problem in such lock cylinders, when the lock cylinder is to be closable on both sides by means of the knob and/or key only with corresponding access authorization. The lock tab is then firmly connected to the lock core and/or knob shaft, which is blocked by a blocking element mounted in the cylinder housing. Relatively high forces can be applied, in particular, by a rotating knob, which are sufficient to destroy the blocking element. Forcible opening is therefore possible.

The underlying task of the invention is to configure a lock cylinder differently, so that a flexible arrangement of the evaluation electronics, rotating knobs or lock cores with or without key is possible.

The task is solved according to the invention in that the lock tab is freely rotatable in the rest position of the blocking or coupling element relative to the lock core or knob shaft. This has the advantage that no connection at all exists to the lock without access authorization. Without access authorization, the lock tab therefore cannot be operated with an element accessible from the outside even during forcible application.

If a lock core is present on both sides of the housing, the lock tab is therefore freely rotatable relative to both lock cores in the rest position of the blocking or coupling element. If a knob shaft is present on both sides of the housing, the lock tab is freely rotatable relative to the two knob shafts in the rest position of the locking or coupling element. If a lock core is mounted in one receptacle and a knob shaft is mounted to rotate in the other receptacle, the lock tab is freely rotatable relative to the lock core and the knob shaft in the rest position of the blocking or coupling element. In a half-cylinder with only one lock core or only one knob shaft, the lock tab is freely rotatable either relative to the lock core or the knob shaft in the rest position of the coupling element.

According to another variant of the invention, it is proposed that a continuous lock core or continuous knob shaft be present, which extends from one side of the housing to the opposite side and can be operated from both sides by a key or a knob. This variant is favorable, for example, if a rotating knob with the evaluation electronics is present on both sides. In a lock cylinder with knob shaft and lock core, the lock core and knob shaft can be connected to rotate in unison with each other or designed in one piece.

In particular, it can be prescribed that the blocking or coupling element be arranged in or on the lock core or in or on the knob shaft and rotate together with it. Signal transmission via slip ring contacts is no longer required, so that operational security and reliability can be increased.

Mounting of the lock tab in the housing is arbitrary, in principle. It is favorable, if the lock tab is arranged on a rotating sleeve. The blocking or coupling element can then be designed as a driver, which engages in a corresponding recess in the rotating sleeve or lock tab. A very compact design is achieved.

It can be prescribed that the blocking or coupling element includes an electromechanical drive. As an alterative, it is possible for the blocking or coupling element to include an electric motor drive. Both electromagnets and electric motors are available with small dimensions, so that they can easily be integrated into the knob shaft or lock core. There is still the possibility of equipping the lock core with ordinary pin tumblers.

According to a preferred variant of the invention, it is proposed that the electric motor drive have an eccentric drive that moves the driver back and forth between the rest position and the operating position, in which it engages in the recess of the lock tab or rotating sleeve. Because of this a more reliable operation is achieved with very compact design. In particular, electric motors are easy to control and have relatively low current consumption. In particular, the electric motor can be switched off in one or the other end position, so that power is no longer consumed after the lifting movement, both into the rest position and into the operating position. The lifetime of the generally line voltage-independent power supply can therefore be increased.

According to another variant of the invention, the rest position and/or operating position of the driver lie beyond the corresponding dead centers of the eccentric by a predetermined rotation angle. The corresponding rotation angle can be 10° to 30° beyond the corresponding dead center. It is then advantageous if the eccentric, after reaching the rotation angle, stops against a stop that limits and prevents further rotational movement. This has the advantage that the end positions can be achieved with safety and reproducibility. In particular, over-rotation beyond the end position can be reliably avoided. The eccentric can also be held better in these end positions, for example, by spring or blocking elements, whose holding force can be overcome by the motor force.

The eccentric drive for this purpose can have a pin arranged eccentrically around the motor shaft, which engages in a groove extending across the lifting movement of the driver and perpendicular to the motor shaft, whose position and length are dimensioned, so that a rotational movement from the rest position to the operating position is only possible in one direction of rotation, and the rotational movement from the operating position to the rest position of the driver is only possible in the opposite direction of rotation. The motor then need only be controlled accordingly, namely, left-running to achieve the rest position and right-running to achieve the operating position or vice versa. This is possible with simple technical means.

It is also expedient if the length and position of the groove are chosen, so that further rotation of the eccentric from the rest position to the operating position of the driver beyond dead center is possible by the rotation angle, and vice versa. However, the length of the groove, in this extent, which corresponds to further rotation in the same direction of rotation, is designed shortened, so that further rotation beyond 90°, and preferably beyond 45°, is not possible, in order to prevent over-rotation. The desired and deliberate lifting movement of the driver by an eccentric can therefore be produced with simple means.

Based on the fact that the lock tab is mounted freely rotatable relative to the knob shaft or the lock core and therefore also freely rotatable relative to the driver on the cylinder housing, the free end of the driver in the rest position and the recess of the lock tab are not necessarily flush relative to each other. Movement of the rigid driver from the rest position to the operating position is not possible in the rotated recess. It is therefore proposed according to the invention that the driver include a slide, whose free end is guided in a sleeve, whose free end, in the operating position, enters the recess of the lock tab or rotating sleeve, and in whose interior a compression spring is arranged, which cooperates with the free end of the pin. This has the advantage that the slide can then also be moved, when the recess of the lock tab is rotated and not flush with the stroke of the driver. After movement of the slide into its operating position, the sleeve is biased, so that during rotation of the knob shaft or lock core relative to the lock tab, the free end becomes flush with the recess and is locked in.

It is favorable, if the sleeve has a stop on its side opposite the free end, against which a thickened end of the slide stops. This has the advantage that the sleeve, during movement of the slide, is necessarily entrained in the rest position. Jamming of the sleeve in the recess is avoided.

It is also expedient, if the depth of the recess of the lock tab or rotating sleeve is dimensioned, so that with the driver engaged, the compression spring in the sleeve is still under stress. Because of this, a situation is achieved, in which the eccentric is kept under bias in the operating position. Since the operating position lies behind dead center in the direction of rotation of the eccentric, back rotation of the eccentric, when the driver is engaged, is prevented.

It is also expedient, if the driver is held by a spring force in the rest position. Since the rest position also lies behind the corresponding dead center in the direction of rotation of the eccentric, back-rotation of the eccentric is prevented, when the driver is disengaged.

Figure 2:
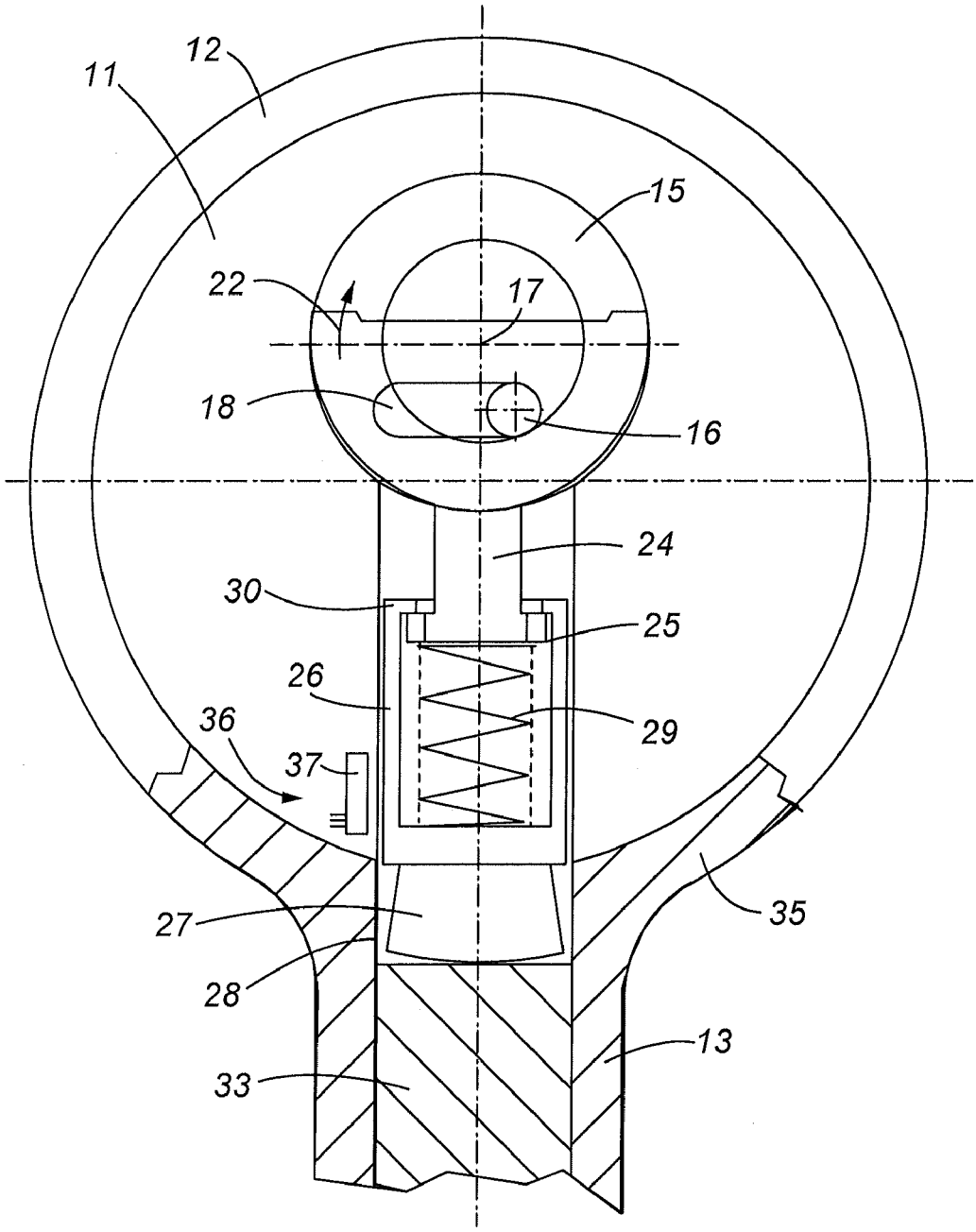
Figure 3:
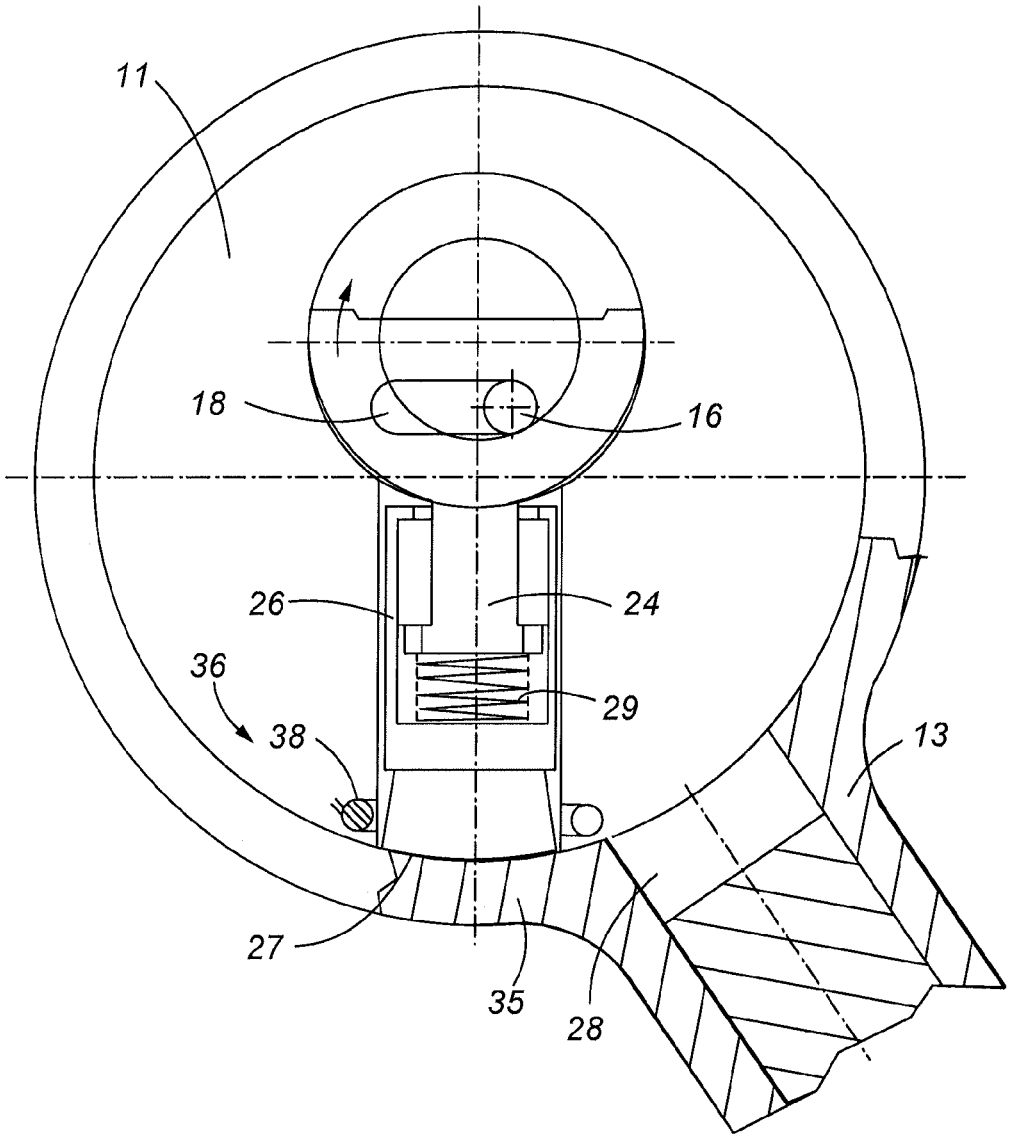
Figure 4:
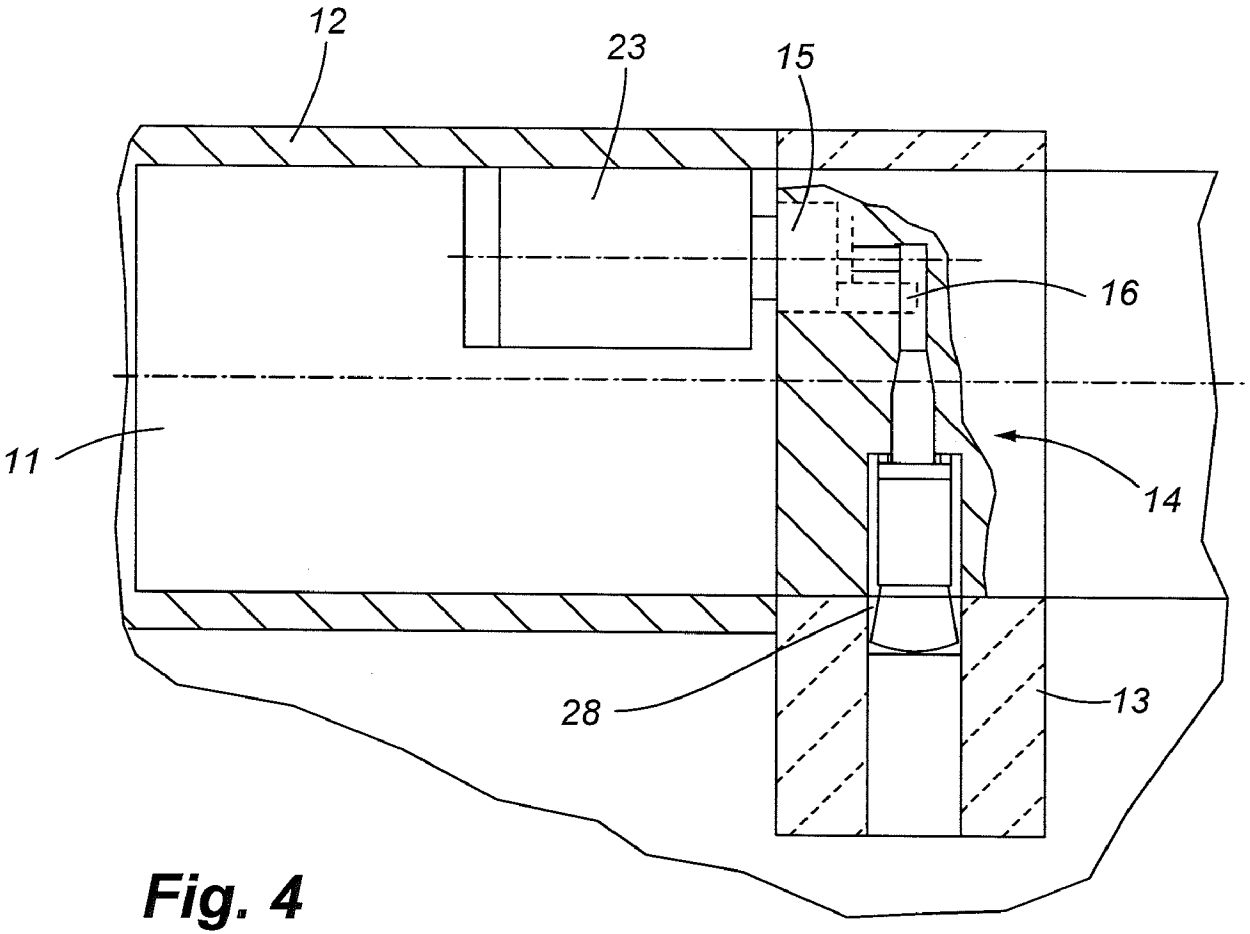
Figure 5:
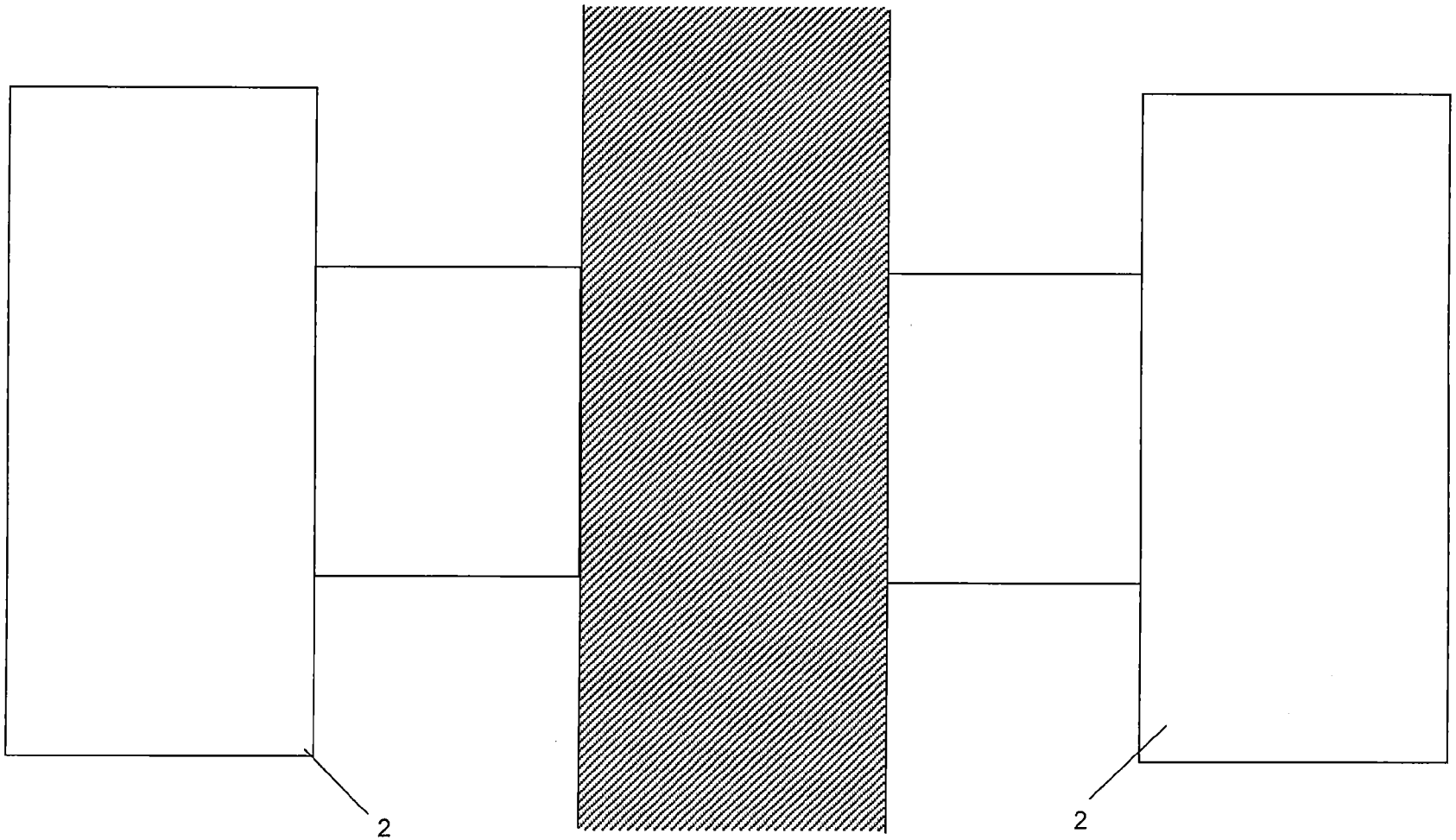

The invention is described below by means of a schematic drawing. In the drawing:

FIG. 1 shows a view of the knob shaft with eccentric and driver in the rest position FIG. 2 shows a view of the knob shaft with eccentric and driver in the operating position FIG. 3 shows a view of the knob shaft with eccentric and driver in the operating position, but with the rotated lock tab FIG. 4 shows a side view of a knob shaft, and FIG. 5 shows a side view of a double-sided lock cylinder.

The knob shaft 11 depicted in the drawing is rotatable in a hollow cylindrical receptacle 12 of a lock cylinder (not further shown). As an alternative, a lock core can be mounted in the hollow cylindrical receptacle, which can be operated by means of a key, especially via mechanical tumblers. The depicted knob shaft would correspond to the depiction of a lock core relevant here, so that only the knob shaft is referred to subsequently.

The knob shaft 11 is connected to rotate in unison, in a manner not shown, to a rotating knob. Evaluation electronics with electronic devices are also provided, which, in known fashion, can query and evaluate an electronic access code of a key or other key element. The lock cylinder also has a lock tab 13, which cooperates with a lock bolt of a lock (not shown).

In a known access authorization, an electromechanically operating blocking or coupling element 14, further described below, is activated, through which a splined connection is produced between the lock tab and knob shaft 11. The lock cylinder can then be operated by rotating the knob shaft with the rotating knob or the lock core by means of a key. The lock cylinder, in basic design, dimensions, especially with respect to electronic recording and evaluation of the access code, corresponds to an ordinary electromechanical lock cylinder, and therefore requires no further explanation.

The arrangement, in detail, is such that the lock tab is mounted to freely rotate by means of a rotary sleeve 35 on the knob shaft in the housing. The electromechanically operating blocking or coupling element 14 is arranged in the knob shaft 11 and includes an eccentric with a rotor 15, on which an axial extending pin 16 is arranged eccentric to eccentric axis 17. The pin 16 cooperates via a groove 18 with a driver 19, which moves up and down, based on the rotary movement of the rotor. The driver 19, for this purpose, is guided in a guide channel 20 of knob shaft 11 linearly and in the radial direction to the knob shaft.

Groove 18 extends essentially across the lift direction of driver 19. The location and length of the groove are chosen, so that, starting from the rest position depicted in FIG. 1, merely by rotation of rotor 15 in direction of rotation 21, the driver 19 can be brought into the operating position depicted in FIG. 2. The driver can be brought back into the rest position from the operating position merely by rotation in direction 22.

The length and position of the groove are also chosen, so that the eccentric, in its end positions, can be rotated beyond dead center of the corresponding position by an angle of rotation. This angle can amount to 10° to 30°. Because of this, the driver experiences a jerky movement, but this jerky stroke, relative to the total stroke between the rest position and operating position, is limited and does not affect the blocking or release function of the driver. However, the region of the groove, depicted on the right in the drawing, is dimensioned, so that further rotation of the rotor in rotation direction 22 by more than the stipulated angle of rotation beyond the top dead center (rest position) is not possible, since the pin 16 stops beforehand on the front limitation of the groove. The same applies for movement in direction of rotation 21 beyond the bottom dead center (operating position). A situation is therefore achieved, in which the driver is held securely by the eccentric in the corresponding end position, since complete back rotation is possible only beyond the dead center, but in the opposite direction. The corresponding end position is therefore always reliably reached and maintained, when the drive motor 23 of the eccentric is driven sufficiently long with power for rotation in one or the other direction.

The driver 19 has a slide 24, whose one end carries groove 18 and is mounted on the pin 16 of the eccentric. The free end 25 of the slide is guided in a sleeve 26. The opposite free end 27 of the sleeve enters a recess 28 of the lock tab in the operating position depicted in FIG. 2. A splined connection is then present between the lock tab and the knob shaft and therefore between the lock tab and the rotary knob, and the lock can be operated.

A compression spring 29 is arranged in the interior of sleeve 26, which cooperates with the free end of the slide. A stop 30 is present on the side of sleeve 26 opposite the free end, against which the thickened end 25 of slide 24 stops. The sleeve is therefore reliably secured on the slide. Because of this arrangement, a situation is achieved, in which the slide can be brought by the eccentric from the rest position of the drive, when the free end 27 of sleeve 26, as shown in FIG. 3, is not flush with the recess 28 of lock pin 13. Instead, the free end 27 lies against the inside wall of rotary sleeve 35 and the compression spring is compressed. The free end 27 is locked first during rotational movement of the knob shaft, as soon as the free end 27 goes beyond the recess. Reliable operation is therefore also achieved with a rotated lock tab, which is freely rotatable in the rest position of the driver relative to the knob shaft, and also relative to the housing of the lock cylinder.

The free end 27 of the sleeve is formed as a widening protrusion 32 with a narrower neck region 34 and a rounded-off front edge. Reliable locking of the protrusion is therefore achieved, when the tightened spring 29 extends over recess 28.

It is also prescribed that the recess 28 of lock tab 13 is closed in the introduction direction of the driver or has a stop 33, in which the depth of the recess is dimensioned, so that when the protrusion 32 is entered, the compression spring 29 is still under stress and the free end 25 of the slide still does not lie against stop 30. A situation is therefore achieved, in which the eccentric pin 16 is held via the slide and groove in the end position of the eccentric, corresponding to the operating position beyond the corresponding dead center under stress. The eccentric can then no longer rotate back by itself, for example, by gravity, even if the power supply of the drive motor is interrupted.

In the end position corresponding to the rest position, a force of a compression spring (not shown), for example, a leaf or coil spring, acts on the upper region 31 of slide 24 in the drawing. Because of this, the eccentric pin 16 is held via the slide 24 and groove 18 in the end position of the eccentric, corresponding to the rest position via the corresponding dead center under stress. The eccentric can no longer be rotated back in this position by itself, for example, by gravity, even if the power supply of the drive motor is interrupted. Secure holding of the eccentric and therefore the driver in both end positions is therefore guaranteed.

For perfect functioning of the lock cylinder even under unfavorable conditions, it is essential to know the position of the coupling element. In particular, if the lock cylinder is not to be operated, it is important to guarantee that the coupling element is situated in the rest position. In principle, it is possible, with the evaluation electronics present anyway, after activation of the lock cylinder, with time intervals to drive the coupling element several times, for example, the eccentric motor, so that it enters the rest position. It is not always ensured, on this account, that the coupling element is actually situated in the rest position.

It can therefore be proposed that a recording device 36 is present that records the position of the coupling element. The recording device can include at least one hall 37 and/or at least one capacitive or inductive sensor 38 or a switch 39, which cooperates with a moving element of the coupling element. A hall sensor 37 is shown as an example in FIG. 2 and a capacitive sensor 38 is shown in FIG. 3 in the form of a capacitor arrangement of half-rings, which are influenced based on the position of the driver. The driver preferably consists of metal, so that its position in front of the hall sensor or between the capacitor rings can be easily detected.

FIG. 1 shows and end switch 39, which cooperates with the eccentric of the motor. The end switch can be designed as a pushbutton, which simultaneously applies a spring force, in order to keep the driver in the rest position behind the top dead center of the eccentric.

A signal that corresponds to the position of the coupling element, and especially the driver, can be generated by the sensors or the switch. A signal can be present, when the coupling element or the driver 19 is in the operation position. As long as this signal is present, the coupling element is driven by the evaluation electronics to enter the rest position. Naturally, it can also be prescribed that a signal be present, if the coupling element is in the rest position. Driving of the coupling element and/or query of the signal can occur in cycles or after a predetermined interval.

By this arrangement of the driver and the eccentric driving in the knob shaft or in the lock core and a freely rotatable lock tab in its rest position relative to the knob shaft or lock correspond or cylinder housing, it is possible, for example, to provide a lock cylinder with a knob on both sides, in which activation is only possible from each side with access authorization. Both rotary knobs can even sit on a common knob shaft. The same applies for a one-sided rotary knob cylinder, which can be operated from one side by a key and from the other side only during access authorization. Lock cylinders with key activation on both sides can also be equipped accordingly.

FIG. 5 depicts a double-sided lock cylinder comprising two knobs 2 connected through a door by a shaft and sockets. The double-sided lock cylinder is similar to the lock cylinder depicted in FIGS. 1-4 except that a knob is provided on each side of the door.

The invention claimed is:

1. An electromechanical lock cylinder that cooperates with evaluation electronics to recognize access authorization, comprising:

two opposite cylindrical receptacles, at least one of which comprises either a lock core, capable of being operated by a key, or a knob shaft, which is connected to rotate in unison with a knob, wherein the lock core or knob shaft cooperates with a lock tab, which operates, in particular, a bolt or a latch of a door lock, and, with a fitting key or access authorization, an electromechanically driven blocking or coupling element is moved from a rest position to an operating position and produces a splined connection between the key or knob and the lock tab, whereas the lock tab, in the rest position of the blocking or coupling element, is freely rotatable relative to the lock core or the knob shaft, wherein the blocking or coupling element is arranged on or in the lock core or on or in the knob shaft and rotates with it, and includes an eccentric that is rotatable between a first and second position such that when the eccentric is in the first position, a driver in communication therewith is in a rest position, and when the eccentric is rotated from the first position to the second position, the driver is moved in a direction radially outwardly and substantially perpendicular to a long axis of the knob shaft or lock core into an operating position, in which the driver engages in a recess of the lock tab or a rotary sleeve, on which the lock tab is arranged.

2. The electromechanical lock cylinder according to claim 1, wherein a continuous lock core or continuous knob shaft is present, which extends from one side of the housing to the opposite side and is capable of being operated from both sides by a key or rotated by a knob.

3. The electromechanical lock cylinder according to claim 1, wherein the rest position and/or the operating position of the driver lie beyond the corresponding dead centers of the eccentric by a predeterminable angle of rotation.

4. The electromechanical lock cylinder according to claim 3, wherein the angle of rotation is 10° to 30° beyond the corresponding dead center.

5. The electromechanical lock cylinder according to claim 1, wherein the driver, in the rest position, is held by spring force.

6. The electromechanical lock cylinder according to claim 1, wherein recording devices are present to record the position of the coupling element.

7. The electromechanical lock cylinder according to claim 6, wherein the recording devices generate at least one signal, and preferably a sequence of signals, in order to move the coupling element into the rest position, as long as the coupling element is in the operating position or still not in the rest position, and if the rest position is to be assumed.

8. The electromechanical lock cylinder according to claim 6, wherein recording devices include at least one hall sensor and/or at least one capacitive or conductive sensor or a switch, which cooperates with a moving element of the coupling element.

9. The electromechanical lock cylinder according to claim 8, wherein the recording devices cooperate with the driver.

10. The electromechanical lock cylinder according to claim 8, wherein the recording devices record the position of the eccentric or the motor shaft.

11. The electromechanical lock cylinder according to claim 1, wherein the blocking or coupling element includes an electromagnetic or electric motor drive.

12. An electromechanical lock cylinder that cooperates with evaluation electronics to recognize access authorization, comprising:

two opposite cylindrical receptacles, at least one of which comprises either a lock core, which is capable of being operated by a key, or a knob shaft, which is connected to rotate in unison with a knob, wherein the lock core or knob shaft cooperates with a lock tab, which operates, in particular, a bolt or a latch of a door lock, and, with a fitting key or access authorization, an electromechanically driven blocking or coupling element is moved from a rest position to an operating position and produces a splined connection between the key or knob and the lock tab, whereas the lock tab, in the rest position of the blocking or coupling element, is freely rotatable relative to the lock core or the knob shaft, wherein the blocking or coupling element is arranged on or in the lock core or on or in the knob shaft and rotates with it, and includes an eccentric, which moves a driver included in the blocking or coupling element back and forth between the rest position and the operating position, in which it engages in a recess of the lock tab or a rotary sleeve, on which the lock tab is arranged, wherein the eccentric has a pin arranged eccentrically around a motor shaft, which engages in a groove extending across a lift movement of the driver and perpendicular to the motor shaft, whose position and length are dimensioned, so that a rotary movement from the rest position into the operating position is only possible in one direction of rotation, and the rotational movement from the operating position into the rest position of the driver is only possible in the opposite direction of rotation.

13. The electromechanical lock cylinder according to claim 12, wherein the length and position of the groove are chosen, in order to permit further rotation of the eccentric from the rest position of the operating position of the driver beyond the dead center by the angle of rotation and vice versa.

14. The electromechanical lock cylinder according to claim 12, wherein the driver includes a slide, whose free end is guided in a sleeve, wherein a free end of the sleeve enters the recess of the lock tab or rotary sleeve, wherein a compression spring is arranged in an interior of the sleeve, and wherein the sleeve cooperates with a free end of the pin via the slide.

15. The electromechanical lock cylinder according to claim 14, wherein the depth of the recess of the lock tab or the rotary sleeve is dimensioned, so that when the driver is engaged, the compression spring in the rotary sleeve is still under tension.

16. The electromechanical lock cylinder according to claim 14, wherein the rotary sleeve, on its side opposite the free end, has a stop, against which a thickened end of the slide stops.

17. The electromechanical lock cylinder according to claim 16, wherein the depth of the recess of the lock tab or the rotary sleeve is dimensioned, so that when the driver is engaged, the compression spring in the rotary sleeve is still under tension.

18. An electromechanical lock cylinder, which cooperates with an evaluation electronics to recognize access authorization, comprising:

two opposite cylindrical receptacles in which at least one of a lock core and/or knob shaft operatively associated with the cylindrical receptacles cooperate with a lock tab, and especially operate a bolt or latch of a door lock, and with a fitting key and/or access authorization, an electromechanically driven blocking or coupling element is moved from a rest position to an operating position and produces a splined connection between the key and/or knob and the lock tab, whereas the lock tab, in the rest position of the blocking or coupling element, is freely rotatable relative to the lock core and the knob shaft, wherein the blocking or coupling element is arranged on or in the lock core or on or in the knob shaft and rotates with it, and also includes an eccentric that is rotatable between a first and second position, a driver in communication with the eccentric and moveable radially outwardly and inwardly and substantially perpendicularly between a first position and a second position relative to a long axis of either the lock core or knob shaft, such that when the eccentric is in the first position, the driver in communication therewith is in a rest position, and when the eccentric is rotated from the first position to the second position, the driver is moved into an operating position, in which the driver engages in a recess of the lock tab or a rotary sleeve, on which the lock tab is arranged.

19. The electromechanical lock cylinder according to claim 18, wherein the two opposite cylindrical receptacles comprise a lock core as one cylindrical receptacle and a knob shaft as the other cylindrical receptacle, and wherein the lock core and knob shaft are connected to rotate in unison with each other or are made in one piece.

20. The electromechanical lock cylinder according to claim 18, wherein the rest position and/or the operating position of the driver lie beyond the corresponding dead centers of the eccentric by a predeterminable angle of rotation.

21. The electromechanical lock cylinder according to claim 20, wherein the angle of rotation is 10° to 30° beyond the corresponding dead center.

22. The electromechanical lock cylinder according to claim 18, wherein the driver, in the rest position, is held by spring force.

23. The electromechanical lock cylinder according to claim 18, wherein recording devices are present to record the position of the coupling element.

24. The electromechanical lock cylinder according to claim 23, wherein the recording devices generate at least one signal, and preferably a sequence of signals, in order to move the coupling element into the rest position, as long as the coupling element is in the operating position or still not in the rest position, and if the rest position is to be assumed.

25. The electromechanical lock cylinder according to claim 23, wherein recording devices include at least one hall sensor and/or at least one capacitive or conductive sensor or a switch, which cooperates with a moving element of the coupling element.

26. The electromechanical lock cylinder according to claim 25, wherein the recording devices cooperate with the driver.

27. The electromechanical lock cylinder according to claim 25, wherein the recording devices record the position of the eccentric or the motor shaft.

28. The electromechanical lock cylinder according to claim 18, wherein the blocking or coupling element includes an electromagnetic or electric motor drive.

29. An electromechanical lock cylinder, which cooperates with an evaluation electronics to recognize access authorization, comprising:

two opposite cylindrical receptacles, in which, on one side of the housing, a lock core, which is capable of being operated by a key, and, on the opposite side, a knob shaft, which is connected to rotate in unison with a knob, are mounted to rotate, in which the lock core and/or knob shaft cooperate with a lock tab, and especially operate a bolt or latch of a door lock, and with a fitting key and/or access authorization, an electromechanically driven blocking or coupling element is moved from a rest position to an operating position and produces a splined connection between the key and/or knob and the lock tab, whereas the lock tab, in the rest position of the blocking or coupling element, is freely rotatable relative to the lock core and the knob shaft, wherein the blocking or coupling element is arranged on or in the lock core or on or in the knob shaft and rotates with it, and also includes an eccentric, which moves a driver back and forth between the rest position and the operating position, in which it engages in a recess of the lock tab or a rotary sleeve, on which the lock tab is arranged, wherein the eccentric has a pin arranged eccentrically around a motor shaft, which engages in a groove extending across the lift movement of the driver and perpendicular to the motor shaft, whose position and length are dimensioned, so that a rotary movement from the rest position into the operating position is only possible in one direction of rotation, and the rotational movement from the operating position into the rest position of the driver is only possible in the opposite direction of rotation.

30. The electromechanical lock cylinder according to claim 29, wherein the length and position of the groove are chosen, in order to permit further rotation of the eccentric from the rest position of the operating position of the driver beyond the dead center by the angle of rotation and vice versa.

31. The electromechanical lock cylinder according to claim 29, wherein the driver includes a slide, whose free end is guided in a sleeve, wherein a free end of the sleeve enters the recess of the lock tab or rotary sleeve, wherein a compression spring is arranged in an interior of the sleeve, and wherein the sleeve cooperates with a free end of the pin via the slide.

32. The electromechanical lock cylinder according to claim 31, wherein the depth of the recess of the lock tab or the rotary sleeve is dimensioned, so that when the driver is engaged, the compression spring in the rotary sleeve is still under tension.

33. The electromechanical lock cylinder according to claim 31, wherein the rotary sleeve, on its side opposite the free end, has a stop, against which a thickened end of the slide stops.

34. The electromechanical lock cylinder according to claim 33, wherein the depth of the recess of the lock tab or the rotary sleeve is dimensioned, so that when the driver is engaged, the compression spring in the rotary sleeve is still under tension.

35. An electromechanical lock cylinder, which cooperates with evaluation electronics to recognize an access authorization, comprising:

a cylindrical receptacle, in which either a lock core, which is capable of being operated by a key, or a knob shaft, which is connected to rotate in unison with a knob, is mounted to rotate, in which the lock core or the knob shaft cooperate with a lock tab, which operates, in particular, a bolt or latch of a door lock, and, with a fitting key and/or access authorization, an electromechanically driven blocking or coupling element is moved from a rest position to an operating position and produces a splined connection between the key or knob and the lock tab, whereas the lock tab, in the rest position of the blocking or coupling element, is freely rotatable relative to the lock core or to the knob shaft, wherein the blocking or coupling element is arranged on or in the lock core or on or in the knob shaft and rotates with it, and also includes an eccentric that is rotatable between a first and second position such that when the eccentric is in the first position, a driver in communication therewith is in a rest position, and when the eccentric is rotated from the first position to the second position, the driver is moved in a direction radially outwardly and substantially perpendicular relative to a long axis of the lock core or knob shaft into an operating position, in which the driver engages in a recess of the lock tab or a rotary sleeve, on which the lock tab is arranged.

36. The electromechanical lock cylinder according to claim 35, wherein the rest position and/or the operating position of the driver lie beyond the corresponding dead centers of the eccentric by a predeterminable angle of rotation.

37. The electromechanical lock cylinder according to claim 36, wherein the angle of rotation is 10° to 30° beyond the corresponding dead center.

38. The electromechanical lock cylinder according to claim 35, wherein the driver, in the rest position, is held by spring force.

39. The electromechanical lock cylinder according to claim 35, wherein recording devices are present to record the position of the coupling element.

40. The electromechanical lock cylinder according to claim 39, wherein the recording devices generate at least one signal, and preferably a sequence of signals, in order to move the coupling element into the rest position, as long as the coupling element is in the operating position or still not in the rest position, and if the rest position is to be assumed.

41. The electromechanical lock cylinder according to claim 39, wherein recording devices include at least one hall sensor and/or at least one capacitive or conductive sensor or a switch, which cooperates with a moving element of the coupling element.

42. The electromechanical lock cylinder according to claim 41, wherein the recording devices cooperate with the driver.

43. The electromechanical lock cylinder according to claim 41, wherein the recording devices record the position of the eccentric or the motor shaft.

44. The electromechanical lock cylinder according to claim 35, wherein the blocking or coupling element includes an electromagnetic or electric motor drive.

45. An electromechanical lock cylinder, which cooperates with evaluation electronics to recognize an access authorization, comprising:

a cylindrical receptacle, in which either a lock core, which is capable of being operated by a key, or a knob shaft, which is connected to rotate in unison with a knob, is mounted to rotate, in which the lock core or the knob shaft cooperate with a lock tab, which operates, in particular, a bolt or latch of a door lock, and, with a fitting key and/or access authorization, an electromechanically driven blocking or coupling element is moved from a rest position to an operating position and produces a splined connection between the key or knob and the lock tab, whereas the lock tab, in the rest position of the blocking or coupling element, is freely rotatable relative to the lock core or to the knob shaft, wherein the blocking or coupling element is arranged on or in the lock core or on or in the knob shaft and rotates with it, and also includes an eccentric, which moves a driver back and forth between the rest position and the operating position, in which it engages in a recess of the lock tab or a rotary sleeve, on which the lock tab is arranged, wherein the eccentric has a pin arranged eccentrically around a motor shaft, which engages in a groove extending across the lift movement of the driver and perpendicular to the motor shaft, whose position and length are dimensioned, so that a rotary movement from the rest position into the operating position is only possible in one direction of rotation, and the rotational movement from the operating position into the rest position of the driver is only possible in the opposite direction of rotation.

46. The electromechanical lock cylinder according to claim 45, wherein the length and position of the groove are chosen, in order to permit further rotation of the eccentric from the rest position of the operating position of the driver beyond the dead center by the angle of rotation and vice versa.

47. The electromechanical lock cylinder according to claim 45, wherein the driver includes a slide, whose free end is guided in a sleeve, wherein a free end of the sleeve enters the recess of the lock tab or rotary sleeve, wherein a compression spring is arranged in an interior of the sleeve, and wherein the sleeve cooperates with a free end of the pin via the slide.

48. The electromechanical lock cylinder according to claim 47, wherein the depth of the recess of the lock tab or the rotary sleeve is dimensioned, so that when the driver is engaged, the compression spring in the rotary sleeve is still under tension.

49. The electromechanical lock cylinder according to claim 47, wherein the rotary sleeve, on its side opposite the free end, has a stop, against which a thickened end of the slide stops.

50. The electromechanical lock cylinder according to claim 49, wherein the depth of the recess of the lock tab or the rotary sleeve is dimensioned, so that when the driver is engaged, the compression spring in the rotary sleeve is still under tension.

* * * * *